US008308879B2

(12) United States Patent
Runemard et al.

(10) Patent No.: US 8,308,879 B2
(45) Date of Patent: Nov. 13, 2012

(54) METHOD AND DEVICE FOR MIXING AND INITIATING A PYROTECHNIC CHARGE

(75) Inventors: Mats Runemard, Karlskoga (SE); Christian Vieider, Uppsala (SE)

(73) Assignee: BAE Systems Bofors AB, Karlskoga (SE)

( * ) Notice: Subject to any disclaimer, the term of this patent is extended or adjusted under 35 U.S.C. 154(b) by 142 days.

(21) Appl. No.: 12/667,770

(22) PCT Filed: May 30, 2008

(86) PCT No.: PCT/SE2008/000369

§ 371 (c)(1), (2), (4) Date: Apr. 29, 2010

(87) PCT Pub. No.: WO2009/008794

PCT Pub. Date: Jan. 15, 2009

(65) Prior Publication Data

US 2011/0011294 A1 Jan. 20, 2011

(30) Foreign Application Priority Data

Jul. 6, 2007 (SE) ..... 0701645

(51) Int. Cl.

| | |
|---|---|
| ***C06B 47/00*** | (2006.01) |
| ***D03D 23/00*** | (2006.01) |
| ***D03D 43/00*** | (2006.01) |

(52) U.S. Cl. ... 149/109.6; 149/1; 149/108.8; 149/109.2; 149/109.4

(58) Field of Classification Search ..... 149/109.6, 149/1, 108.8, 109.2, 109.4
See application file for complete search history.

(56) References Cited

U.S. PATENT DOCUMENTS

| | | | | |
|---|---|---|---|---|
| 5,607,181 | A * | 3/1997 | Richardson et al. | 280/737 |
| 6,984,274 | B2 * | 1/2006 | Hofmann et al. | 149/2 |
| 2006/0065337 | A1 * | 3/2006 | Perut et al. | 149/1 |

OTHER PUBLICATIONS

Clement et al.,phys.stat.sol. (a) 202. No. 8 1357-1364 (2005).*
International Search Report and Written Opinion issued in related International Application No. PCT/SE2008/000369.

* cited by examiner

*Primary Examiner* — James McDonough
(74) *Attorney, Agent, or Firm* — Connolly Bove Lodge & Hutz LLP

(57) ABSTRACT

Method and device for mixing and initiating a pyrotechnic charge, comprising at least one coherent porous fuel structure (16) and at least one oxidizer (8). According to the invention, the coherent porous fuel structure (16) and the oxidizer (8) are placed apart in a mixing device (1, 20) to prevent unintentional ignition, and in which the oxidizer (8), in response to the action of a force upon the mixing device (1, 20), for example upon firing of an artillery shell, is transported into the coherent porous fuel structure (16), after which the obtained pyrotechnic charge is initiated after a set time delay.

5 Claims, 2 Drawing Sheets

METHOD AND DEVICE FOR MIXING AND INITIATING A PYROTECHNIC CHARGE

CROSS REFERENCE TO RELATED APPLICATIONS

Figure 1:
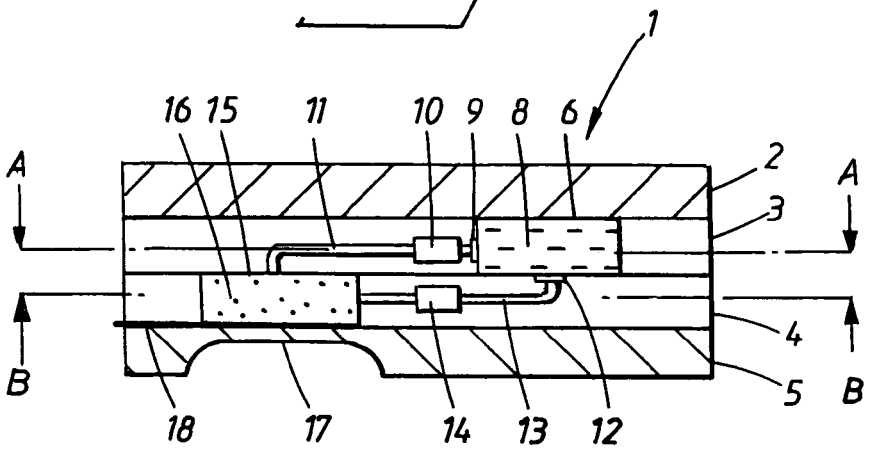

This application is a national phase of PCT/SE2008/000369, filed on May 30, 2008 which claims priority to SE 0701645-4 filed Jul. 6, 2007, the entire contents of all are hereby incorporated by reference.

TECHNICAL FIELD

The present invention relates to a method and a device for mixing and initiating a pyrotechnic charge, comprising at least one coherent porous fuel structure and at least one oxidizer.

BACKGROUND

At present many types of pyrotechnic charges are found, hereinafter also referred to as primers, which are used in civil and/or military applications. Civil applications can be, for example, gas generators for airbags or safety belt stretchers, in which a pyrotechnic charge is used to generate gas. Military applications can be artillery shells in which a pyrotechnic primer forms part of an ignition chain for detonating an initiator.

A pyrotechnic charge comprises a mixture of at least one reducing agent, hereinafter also referred to as fuel, and at least one oxidizing agent, hereinafter referred to as oxidizer, as well as further additives such as, for example, bonding agents and burning rate moderators. In conventional pyrotechnic charges, the fuel and the oxidizer are normally comprised as a powder mixture. More recently, however, new types of pyrotechnic charges have been developed, in which the fuel consists of a coherent porous fuel structure and in which the oxidizer fills the porous structure. The material in the porous fuel structure is constituted, for example, by silicon, and the porosity lies within the range 50-70% by volume, in certain cases the porosity exceeding 70% by volume (highly porous structures).

In patent specification US 2003/0148569 A1, a pyrotechnic charge is described, which pyrotechnic charge is produced by a saturated solution of lithium nitrate being fed to a coherent porous silicon structure. After the solution has been absorbed in the porous fuel structure, the solvent is distilled off and the oxidizer is precipitated as fine crystals in the porous silicon structure.

The advantage of utilizing a coherent highly porous fuel structure is that a large specific contact surface area between the fuel and the oxidizer is achieved. The large contact surface area means a high availability of the oxygen of the oxidizer during the combustion, which means a low slag component in the combustion products and little effect upon the environment.

A drawback is, however, that the large specific contact surface area between the oxidizer and the highly porous fuel structure strongly increases the sensitivity of the pyrotechnic charge to impacts, shocks and static electricity, which in turn increases the risk of unintentional ignition.

The increased risk of unintentional ignition can have serious consequences if a pyrotechnic charge of the said type is used, for example, in an artillery shell or in an airbag system for vehicles.

The technical problem on which the present invention is founded has been the risk of unintentional ignition of pyrotechnic primers comprising at least one coherent porous fuel structure and at least one oxidizer.

SUMMARY OF THE INVENTION

A primary object of the invention is to provide an improved method and an improved device for mixing and initiating a pyrotechnic charge comprising at least one coherent porous fuel structure and at least one oxidizer, which method and which device have been improved by the risk of unintentional ignition having been eliminated or heavily reduced.

The said object, and other objectives which are not enumerated here, are satisfactorily met within the framework of the content of the present independent patent claims.

According to the invention, an improved method for mixing and initiating a pyrotechnic charge comprising at least one coherent porous fuel structure and at least one oxidizer has therefore been achieved, in which method the said at least one coherent porous fuel structure and the said at least one oxidizer are placed apart in a mixing device, characterized in that the oxidizer, in response to the possible action of an acceleration force $F_a$, or a rotation force $F_r$, or an acceleration force $F_a$ and a rotation force $F_r$, upon the mixing device, is transported into the coherent porous fuel structure, after which the obtained pyrotechnic charge is initiated.

According to further aspects of the method according to the invention:

- the porous fuel structure is placed in a fuel chamber and the oxidizer is placed in a first oxidizer chamber and in a second oxidizer chamber, in which the oxidizer in the first oxidizer chamber, in response to the action of a rotation force $F_r$ upon the mixing device, is transported to the fuel chamber via a first connecting duct, and/or the oxidizer in the second oxidizer chamber, in response to the action of an acceleration force $F_a$ upon the mixing device, is transported to the fuel chamber via a second connecting duct, after which the pyrotechnic charge is initiated with an ignition device,
- the first connecting duct is opened by the activation of a rotation-sensitive opening device and the second connecting duct is opened by the activation of an acceleration-sensitive opening device,
- the porous fuel structure is placed in a fuel chamber and the oxidizer is placed in an oxidizer chamber, in which the oxidizer is transported to the fuel chamber via a connecting duct in response to the action of an acceleration force $F_a$ and/or a rotation force $F_r$ upon the mixing device, after which the pyrotechnic charge is initiated with an ignition device,
- the connecting duct is opened by the activation of an acceleration and rotation-sensitive opening device.

According to the invention, it is the case for the mixing device that the at least one coherent porous fuel structure and the at least one oxidizer are arranged apart in the mixing device in a way which allows the oxidizer to be transported into the coherent porous fuel structure in response to the possible action of an acceleration force $F_a$ or a rotation force $F_r$, or an acceleration force $F_a$ and a rotation force $F_r$, upon the mixing device, and that the pyrotechnic charge can be initiated after a time lag.

According to further aspects of the mixing device according to the invention:

- the porous fuel structure is placed in a fuel chamber and the oxidizer is placed in a first oxidizer chamber and in a second oxidizer chamber, in which the oxidizer in the first oxidizer chamber, in response to the action of the rotation force $F_r$ upon the mixing device, can be transported to the fuel chamber via a first connecting duct, and the oxidizer in the second oxidizer chamber, in response to the action of the acceleration force $F_a$ upon the mixing device, can be transported to the fuel chamber via a second connecting duct, and the pyrotechnic charge can be initiated with an ignition device after a time delay, the first connecting duct can be opened by a rotation-sensitive opening device and the second connecting duct can be opened by an acceleration-sensitive opening device, the porous fuel structure is placed in a fuel chamber and the oxidizer is placed in an oxidizer chamber, in which the oxidizer can be transported to the fuel chamber via a connecting duct in response to the action of an acceleration force $F_a$ and/or a rotation force $F_r$ upon the mixing device, and the pyrotechnic charge can be initiated with an ignition device after a time delay, the second connecting duct can be opened by an acceleration and rotation-sensitive opening device, the acceleration and rotation-sensitive opening device comprises an acceleration and rotation-sensitive detonating plate dimensioned to break at a predetermined acceleration and/or rotation force ($F_a$, $F_r$).

The foremost advantage with the said method and the said device is that the mixing and the initiation of the coherent porous fuel structure and the oxidizer occurs in direct connection with the use of the pyrotechnic charge, for example upon firing of an artillery shell. Up to the point when the pyrotechnic charge is to be used, the oxidizer and the coherent porous fuel structure are kept apart, which means that they cannot react with one another. By virtue of the said method and device, the risk of unintentional ignition during the handling, transport and storage phases has therefore been eliminated.

The method also then means that the oxidizer and the porous fuel structure are stored on one and the same mixing device, which means that the device is simple and the number of parts is minimal.

Further advantages and effects according to the invention will emerge from the following, detailed description of the invention, including a number of its advantageous embodiments, from the patent claims and from the accompanying drawing figures.

Figure 2:
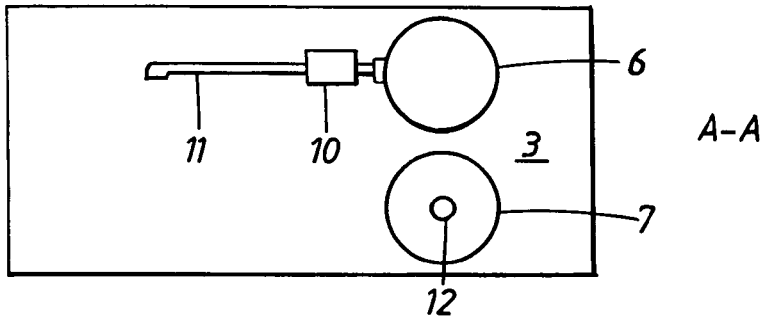
Figure 3:
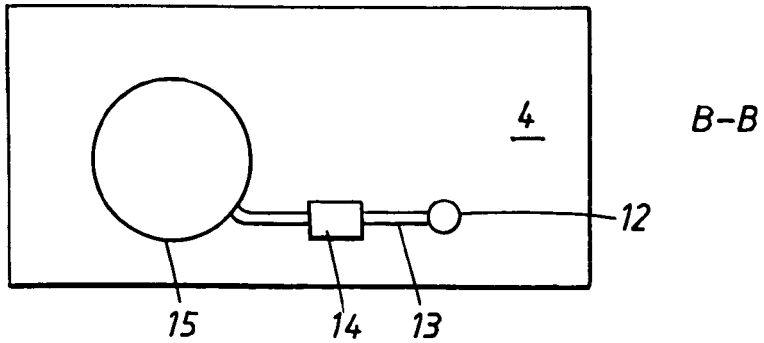
Figure 3:
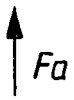
Figure 3:
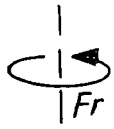
Figure 4:
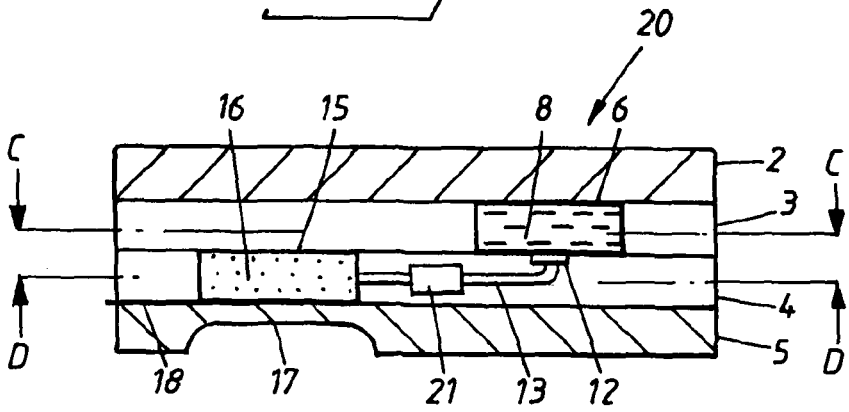
Figure 5:
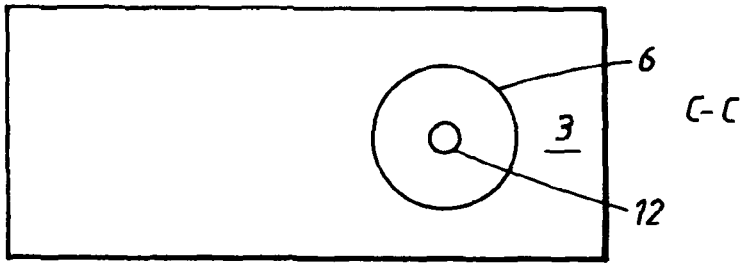
Figure 6:
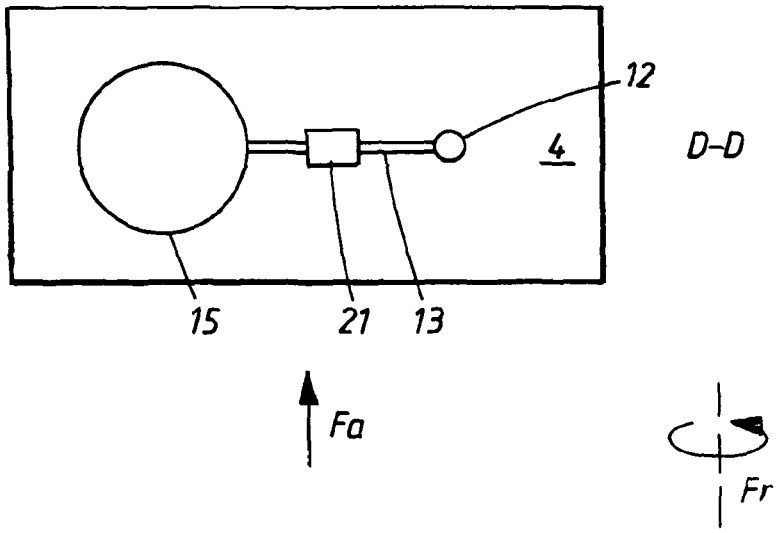

The invention will be described below with reference to the appended figures, in which:

FIG. 1 shows a schematic section through a mixing device having four flat segments for mixing and initiating a pyrotechnic primer comprising a coherent porous fuel structure and at least one oxidizer, FIG. 2 shows a schematic plane section A-A through the second flat segment in the mixing device according to FIG. 1, FIG. 3 shows a schematic plane section B-B through the third flat segment in the mixing device according to FIG. 1, FIG. 4 shows a schematic section through an alternative embodiment of the mixing device according to FIG. 1, FIG. 5 shows a schematic plane section C-C through the second flat segment in the mixing device according to FIG. 4, FIG. 6 shows a schematic plane section D-D through the third flat segment in the mixing device according to FIG. 4.

DETAILED DESCRIPTION

In FIG. 1 is shown a preferred embodiment of the mixing device 1, comprising a fuel chamber 15, which fuel chamber 15 comprises a coherent porous fuel structure 16, and two oxidizer chambers 6, 7 comprising an oxidizer 8. The fuel chamber 15 and the two oxidizer chambers 6, 7 are separated by being arranged in two flat segments 3, 4, a first flat segment 3 comprising the two oxidizer chambers 6, 7 and a second flat segment 4 comprising the fuel chamber 15.

The fuel chamber 15 and the oxidizer chambers 6, 7 are realized as through holes in the flat segments 3, 4. The flat segments 3, 4 are joined together, preferably by gluing. For the joining together of small flat segments, production technology which is used in the production of microelectronics and micromechanics, so-called MEMS technology, can advantageously be used. For applications in which larger mixing devices are included, screwed joints, bolted joints, welded joints or soldered joints can be used. The coherent porous fuel structure 16 in the fuel chamber 15 is configured for fastest possible absorption of the oxidizer 8, preferably by being arranged as one or more thin discs in the fuel chamber 15 (not shown in FIG. 1).

The mixing device 1 further comprises two connecting ducts 11, 13, whereof the first connecting duct 11 connects the first oxidizer chamber 6 to the fuel chamber 15 and the second connecting duct 13 connects the second oxidizer chamber 7 to the fuel chamber 15.

Also belonging to the connecting ducts are two opening devices 10, 14, whereof the first opening device 10 is rotation-sensitive and opens the first connecting duct in response to the action of a predetermined rotation force $F_r$ upon the mixing device 1 (see FIGS. 1-3).

The second opening device 14 is acceleration-sensitive and opens the second connecting duct 13 in response to the action of a predetermined acceleration force $F_a$ upon the mixing device 1.

For initiation of the pyrotechnic charge, the mixing device 1 also comprises an initiating device 18, see FIG. 1, preferably an electric igniter disposed between the flat segments 4 and 5. Finally, in order to achieve a directed detonating effect of the primer, the mixing device 1 also comprises a mechanical weakening 17 disposed in connection with the fuel chamber 15.

As a result of the arrangement of the flat segment 3 on the flat segment 4, the flat segment 4 forms a lower limit surface to the oxidizer chambers 6, 7, whilst the flat segment 3 forms an upper limit surface to the fuel chamber 15. The mixing device 1 further comprises a third and fourth flat segment 2 and 4. The third flat segment 2 is disposed on the first flat segment 3 and forms an upper limit surface to the oxidizer chambers 6, 7. The fourth flat segment 5 is disposed below the second flat segment 4 and forms a lower limit surface to the fuel chamber 15.

The mechanical weakening 17 is preferably disposed in the fourth flat segment 5 in connection with the fuel chamber 15 and has been produced by a part of the flat segment 5 nearest to the fuel chamber 15 having been made weaker, for example by the wall having been made thinner. Alternatively, the mechanical weakening 17 can be exchanged for a detonating plate in the flat segment 5 or can be disposed in connection with the bottom side of the fuel chamber as a bottom plate (not shown in the figures).

The connecting ducts 11, 13 are configured as tubes and are disposed in the flat segments 3, 4, alternatively the connecting ducts 11, 13 can be configured as longitudinal depressions or craters in the flat segments 3, 4 (not shown in the figures). The depressions are closed off by stapling together of the flat segments 3, 4.

The connecting duct 11 extends from one side of the oxidizer chamber 6 and runs parallel with the second flat segment 4 in the direction of the fuel chamber 15 via the rotation-sensitive opening device 10 and onward to the top side of the fuel chamber 15, in which it deviates downwards and connects to the fuel chamber 15.

The rotation-sensitive opening device 10 here consists of a pressure-sensitive membrane (not shown in the figures), which membrane breaks at a predetermined pressure from the oxidizer 8, which predetermined pressure is obtained at a given rotation speed $F_r$ of the mixing device 1.

As an alternative to using a membrane, a pretensioned blocking element can be used, which blocking element is moved or deformed at a predetermined pressure acting from the oxidizer 8.

As an extra security for avoiding leakage from the oxidizer chambers 7, 6, for example during transport and storage, two membranes 9, 12 are disposed in the outlets of the oxidizer chambers 7, 6. The membranes 9, 12 ensure that it is leak-tight between the outlets of the oxidizer chambers 6, 7 and the opening devices 10, should the opening devices 10, 14 be leaky. The initiating device 18 preferably consists of an electric igniter, such as an ignition or resistance wire disposed between the flat segments 4 and 5, and which ignition wire is in contact with the coherent porous fuel structure 16. Alternatively, the ignition device can be constituted by a pyrotechnic igniter, a laser or plasma igniter disposed in the mechanical weakening 17 via a bushing (not shown in FIG. 1). The initiating device 18 is expediently coupled to a time delay unit (not shown in FIG. 1), which time delay unit determines a time delay from activation of an opening device 10, 14 to initiation of the pyrotechnic charge.

The coherent highly porous fuel structure 16 has a porosity within the range 60-90% by volume, the porosity being determined by the amount of oxidizer which is needed in the pyrotechnic charge. The coherent porous fuel structure is preferably constituted by silicon, alternatively carbon, vanadium, beryllium, magnesium and iron, or mixtures thereof, can be used. The oxidizer 8 is normally present as liquid and comprises a dinitramide salt dissolved in a solvent, for example dimethyl formamide or tetrahydrofuran. Other oxidizers of interest are: ammonium perchlorate, potassium perchlorate and potassium nitrate. The function of the shown embodiment is: in response to the action of a predetermined acceleration $F_a$ and/or rotation force $F_R$ upon the mixing device 1, one or both opening devices 10, 14 is/are activated, whereupon the oxidizer 8 is transported to the fuel chamber 15. After the oxidizer 8 has been absorbed in the coherent porous fuel structure 16, the ignition device 18 is activated and the pyrotechnic charge is initiated after a set time delay.

The time delay can either be predetermined, by the ignition device being coupled to a time relay or to a pyrotechnic delay, or variable, by the ignition device being coupled to an external activating sensor, which activating sensor, for example, can be a radar or a laser.

When the gas pressure in the fuel chamber 15 exceeds a predetermined value, the primer is initiated and the mechanical weakening 17 breaks, whereupon the detonating effect from the primer spreads in a set direction.

The directed detonating effect can be used, for example, to initiate an explosive charge in a shell.

In FIGS. 4-6 is shown an alternative embodiment of the mixing device 20, comprising a fuel chamber and an oxidizer chamber 6, in which the fuel chamber 15 comprises a coherent porous fuel structure 16 and the oxidizer chamber 6 comprises an oxidizer 8.

The oxidizer chamber 6 and the fuel chamber 15 are separated from one another by being comprised in two flat segments 3, 4, a first flat segment 3 comprising the oxidizer chamber 6 and a second flat segment 4 comprising the fuel chamber 15.

The mixing device 20 further comprises a connecting duct 13, which connecting duct 13 connects the oxidizer chamber 6 to the fuel chamber 15. Also belonging to the connecting duct is an opening device 21 for opening the connecting duct 13 in response to an acceleration and rotation force. The mixing device 20 also comprises a third and fourth flat segment 2, 5 and an initiating device 18. The flat segments 2, 3, 4 and 5 are arranged in the same way as in the first mixing device 1. The difference is that the opening device 21 is both acceleration- and rotation-sensitive, which means that only one oxidizer chamber 6 is used. Examples of acceleration and/or rotation-sensitive opening devices are membranes which break at a predetermined acceleration, blocking elements in the outlets of the oxidizing chamber, which are moved or deformed at a predetermined rotation/acceleration, electrically actuable valves, which are controlled by sensors, or spring-loaded valve devices, in which the spring force is surmounted at a predetermined rotation/acceleration.

The invention is not limited to the shown embodiments, but can be varied in a variety of ways within the scope of the patent claims.

The invention claimed is:

1. Mixing device for mixing and initiating a pyrotechnic charge, comprising at least one coherent porous fuel structure and at least one oxidizer, in which the at least one coherent porous fuel structure and the at least one oxidizer are arranged apart in a mixing device, wherein the oxidizer is transportable into the coherent porous fuel structure in response to the possible action of an acceleration force $F_a$ or a rotation force $F_r$ or an acceleration force $F_a$ and a rotation force $F_r$, upon the mixing device, and in that the pyrotechnic charge is initiatable and wherein the porous fuel structure is placed in a fuel chamber and the oxidizer is placed in a first oxidizer chamber and in a second oxidizer chamber, in which the oxidizer in the first oxidizer chamber, in response to the action of the rotation force $F_r$ upon the mixing device, can be transported to the fuel chamber via a first connecting duct, and the oxidizer in the second oxidizer chamber, in response to the action of the acceleration force $F_a$ upon the mixing device, can be transported to the fuel chamber via a second connecting duct, and the pyrotechnic charge can be initiated with an initiating device after a set time delay.

2. Mixing device for mixing and initiating a pyrotechnic charge according to claim 1, wherein the first connecting duct can be opened by a rotation-sensitive opening device and in that the second connecting duct can be opened by an acceleration-sensitive opening device.

3. Mixing device for mixing and initiating a pyrotechnic charge, comprising at least one coherent porous fuel structure and at least one oxidizer, in which the at least one coherent porous fuel structure and the at least one oxidizer are arranged apart in a mixing device, wherein the oxidizer is transportable into the coherent porous fuel structure in response to the possible action of an acceleration force $F_a$ or a rotation force $F_r$ or an acceleration force $F_a$ and a rotation force $F_r$, upon the mixing device, and in that the pyrotechnic charge is initiatable and wherein the porous fuel structure is placed in a fuel chamber and in that the oxidizer is placed in an oxidizer chamber, in which the oxidizer can be transported to the fuel chamber via a connecting duct in response to the action of an acceleration force $F_a$ and/or a rotation force $F_r$ upon the mixing device, and in that the pyrotechnic charge can be initiated with an initiating device after a set time delay and the connecting duct can be opened by an acceleration- and rotation-sensitive opening device.

4. Mixing device for mixing and initiating a pyrotechnic charge according to claim 3, wherein the acceleration- and rotation-sensitive opening device comprises an acceleration- and rotation-sensitive detonating plate dimensioned to break at a predetermined acceleration and/or rotation force ($F_a$, $F_r$).

5. Mixing device for mixing and initiating a pyrotechnic charge according to claim 1, wherein the acceleration- and rotation-sensitive opening device comprises an acceleration- and rotation-sensitive detonating plate dimensioned to break at a predetermined acceleration and/or rotation force ($F_a$, $F_r$).

* * * * *